US006145680A

United States Patent [19]

Jussila et al.

[11] Patent Number: 6,145,680

[45] Date of Patent: Nov. 14, 2000

[54] APPARATUS FOR REDUCING OVERLOAD AND DAMPENING COLLISION ENERGY

[75] Inventors: Olavi Jussila, Hyvinkää; Soini Söderena, Röykkä, both of Finland

[73] Assignee: KCI Konecranes International PLC, Hyvinkää, Finland

[21] Appl. No.: 09/159,760

[22] Filed: Sep. 24, 1998

[30] Foreign Application Priority Data

Sep. 24, 1997 [FI] Finland ..... 973770

[51] Int. Cl.[7] ..... B66C 23/38

[52] U.S. Cl. ..... 212/274; 212/308; 254/415; 267/134

[58] Field of Search ..... 212/274, 308; 267/134, 196; 254/277, 413, 414, 415

[56] References Cited

U.S. PATENT DOCUMENTS

| | | | |
|---|---|---|---|
| 3,786,935 | 1/1974 | Vlazny et al. | 212/274 |
| 3,819,014 | 6/1974 | Mortensen . | |
| 3,842,986 | 10/1974 | Hupkes | 212/274 |
| 4,025,055 | 5/1977 | Strolenberg | 212/308 |
| 4,354,608 | 10/1982 | Wudtke | 212/308 |
| 4,597,497 | 7/1986 | Aberegg | 212/274 |
| 4,901,829 | 2/1990 | East, Jr. et al. . | |
| 5,560,162 | 10/1996 | Kemeny . | |
| 5,597,080 | 1/1997 | Culwell . | |

FOREIGN PATENT DOCUMENTS

| | | |
|---|---|---|
| 0358343 | 3/1990 | European Pat. Off. . |
| 1625448 | 12/1969 | Germany . |
| 4422927 A1 | 1/1996 | Germany . |

*Primary Examiner*—Thomas J. Brahan
*Attorney, Agent, or Firm*—Birch, Stewart, Kolasch & Birch, LLP

[57] ABSTRACT

The invention relates to an apparatus for reducing overload and dampening collision energy, for instance, in connection with a container crane, the apparatus comprising a movable bar (16) to receive a load and a resistance device (18) against the predetermined resistance of which the movable bar are able to move in a dampening situation, and the resistance device comprise at least one friction device (18) arranged to cooperate with the movable bar (16).

11 Claims, 3 Drawing Sheets

APPARATUS FOR REDUCING OVERLOAD AND DAMPENING COLLISION ENERGY

BACKGROUND OF THE INVENTION

The invention relates to an apparatus for reducing overload and dampening collision energy acting on lifting ropes of a crane, the apparatus comprising movable means for receiving a load, and resistance means against the predetermined resistance of which the movable means are able to move in a dampening situation, arranged in connection with the lifting ropes of the crane.

Problems caused by overload and collision energy occur, for instance, in connection with container cranes, a typical problematic situation arises when a lifting element is suddenly and unexpectedly caught to a ship to be unloaded during a lifting movement. Another serious situation arises when the lifting element is run at full speed to collide with the lower part of a lifting carriage. This is possible if the control limit of the lifting movement fails to operate.

Damage prevention in connection with cranes is represented by a prior art arrangement wherein a lifting rope of the crane is supplied through a sheave in such a way that a hydraulic cylinder can be placed as a support in the angle formed by the ropes. The pressure required by the rope power is achieved with a machine unit that operates all the time when the crane is employed. On collision, the kinetic energy is converted to heat by means of throttle valves, when a cylinder piston pushes oil ahead. Oil pressure is determined according to the adjustment of the throttle valve. The hydraulic machine unit resets the cylinder to its original operating position. The solutions disclosed in U.S. Pat. No. 5 597 080 and EP 0 358 343 A1 can be given as examples of the prior art technology. Drawbacks of these solutions based on hydraulics are a high purchase price and a constant need for maintenance. Oil leaks may also occur.

Other known applications are mostly buffers operating on hydraulic fluid. Their use is restricted by the fact that buffers cannot be loaded with a continuous rated load, and only reduce the load exceeding the rated load. Buffers of this kind have no separate machine unit. On the other hand, buffers made of polyurethane or a similar material, are very large at high energy levels, and thus in most cases, they do not fit in the structure of the application.

Mechanical solutions are also known, such as for instance, an implementation presented in German Patent Publication DE 44 22 927 A1, in which overload is converted to kinetic and/or electric energy while releasing the lifting ropes of a crane. This technique is also complicated and expensive.

BRIEF DESCRIPTION OF THE INVENTION

The object of the present invention is to avoid the drawbacks of the prior art, such as a high purchase price, separate electric drive, maintenance and a possibility of oil leaks. This is achieved by an apparatus of the invention which is characterized in that the resistance means comprise at least one friction device arranged to cooperate with the movable means, the friction device being arranged in connection with sleaves of the crane's lifting ropes, and the sleave is arranged in a turning support beam, and the movable means comprises a support bar that is linked to the support beam, the support bar cooperating with the friction device, and the friction device is attached to the body structure of the crane.

The operation of the apparatus of the invention is based on friction, and the friction force is predetermined to have the desired value. A very large scale of power and travel, in other words quantity of energy, can be controlled by the same basic solution. For instance, when the apparatus is employed to reduce the effect of overloading on the crane's loading element, which has suddenly got caught during a lifting movement, the rated load of normal use is taken into account and an additional load with the desired safety factor is added thereto. A force triggering the operation of the apparatus, i.e. triggering a relative motion between the friction device and the load-receiving means arranged to move in relation thereto, is determined such that no permanent damage is caused to the equipment. A distance needed for reducing the overload is determined by the quantity of energy needed. The apparatus of the invention reduces the effect of the loading in the same manner in both directions of motion, whereby the movable means can be arranged to move either in or out of the friction device in a dampening situation.

When the apparatus of the invention is employed in the above-described manner in connection with a so called snag-load protection, a limit switch is mounted between the movable elements of the apparatus, which move in relation to each other, the limit switch arresting the rotating masses of the driving mechanism of a structure to be protected, when the above-mentioned elements start moving in relation to one another.

The apparatus of the invention can be easily implemented in such a way that maintenance or spare parts are not needed. An electric overload protection can also be replaced with the same apparatus.

Friction devices are also readily mounted in series, for instance, one after the other on a movable bar, if multiplication of their effect is desired.

In addition to the above-described snag-load protection application, the apparatus of the invention can also be employed as a mere buffer without a preloading force.

The apparatus of the invention can also be applied as a safety solution in a wide variety of other structures, whereby, for instance, a crane can be prevented from toppling, an excavating element of an excavator can be prevented from being damaged, and so on. It is particularly well suited for linear movements without additional arrangements, such as gears or brakes related thereto. The energy level of the apparatus is zero, even though it is ready to operate at full collision speed.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

In the following the invention will be described in greater detail with reference to the attached drawings which are given by way of illustration only, and thus are not limitative of the present invention, and in which.

DETAILED DESCRIPTION OF THE INVENTION

Figure 1:
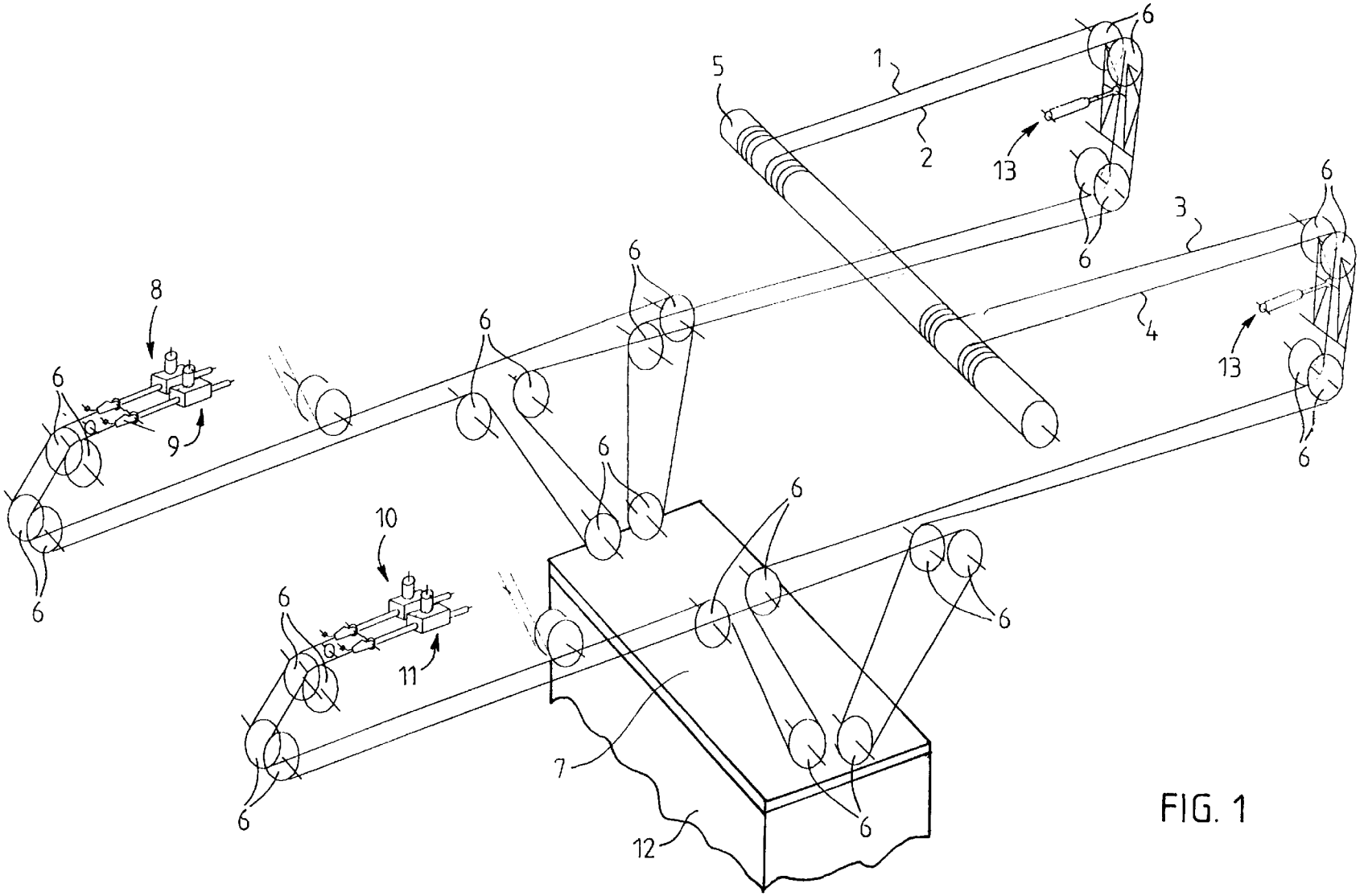
FIG. 1 is a general view of lifting ropes of a container crane and shows an apparatus of the invention positioned in connection with said ropes.

FIG. 1 shows a general view of lifting ropes 1 to 4 of a container crane, the ropes being conchanneled from a rope drum 5, which reels said ropes in and out, via a plurality of sheaves 6, each to a separate device 8 to 11 that prevents a loading element 7 from swaying and twisting. The loading element 7 below the lowermost sheaves is intended for gripping a load (a container) 12, to be lifted vertically and to be moved horizontally. This is a conventional, generally known container crane arrangement, so it will not be described in greater detail herein. Moreover, this arrangement is only one example of the applications of the present invention, and its details are not relevant from the viewpoint of the present invention.

In this embodiment, the dampening apparatus 13 of the invention is arranged in connection with both pairs of lifting ropes 1, 2 and 3, 4 and the sheaves thereof, which are located closest to the rope drum 5, or more precisely, inside the angle formed by the ropes 1 to 4 and each upper and lower pair of sheaves. The purpose of these dampening apparatuses 13 is to prevent the crane's structures from being damaged, when the loading element 7 is suddenly and unexpectedly caught, for instance, in a ship's hold. In this case, the dampening apparatus 13 is to slacken the lifting ropes 1 to 4 and to stop the mechanism driving the rope drum 5.

Figure 2:
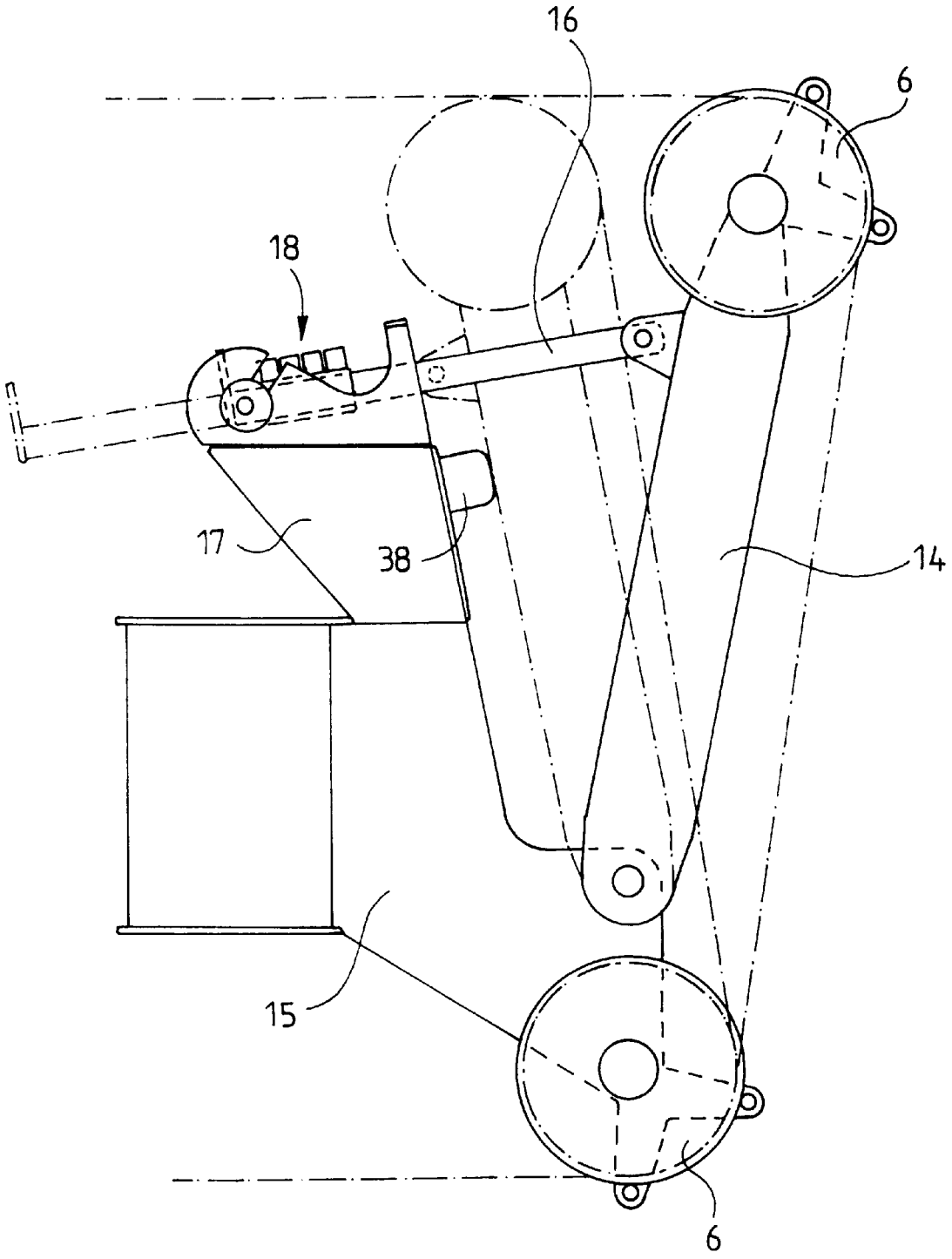
FIG. 2 shows in greater detail the apparatus of the invention positioned in connection with the arrangement of FIG. 1.

FIG. 2 illustrates in greater detail the positioning of the dampening apparatus 13 of the invention at the point shown in FIG. 1. The pair of upper sheaves 6 are arranged in a support beam 14 which is linked in its lower part to the crane's body structure, in this case to a main girder 15 to the effect that the beam 14 may turn and consequently the sheave 6 may move inwards and outwards with the beam 14 in the ropes. A support bar 16 is linked to the upper part of the support beam 14, the support bar cooperating with a friction device 18 attached to the main girder 15 by means of a support platform 17.

Figure 3:
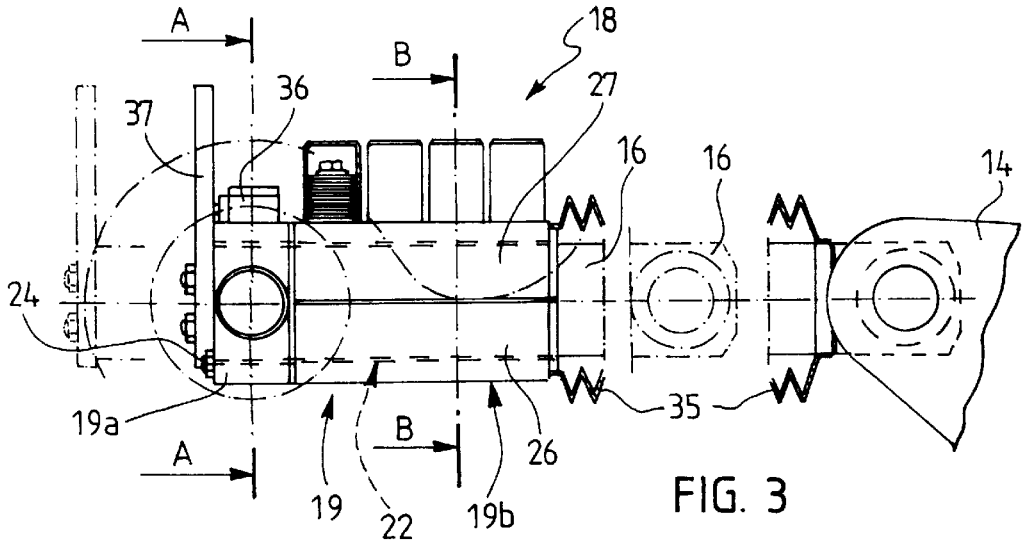
FIG. 3 is a detailed view of the apparatus of the invention shown in FIG. 2.
Figure 4:
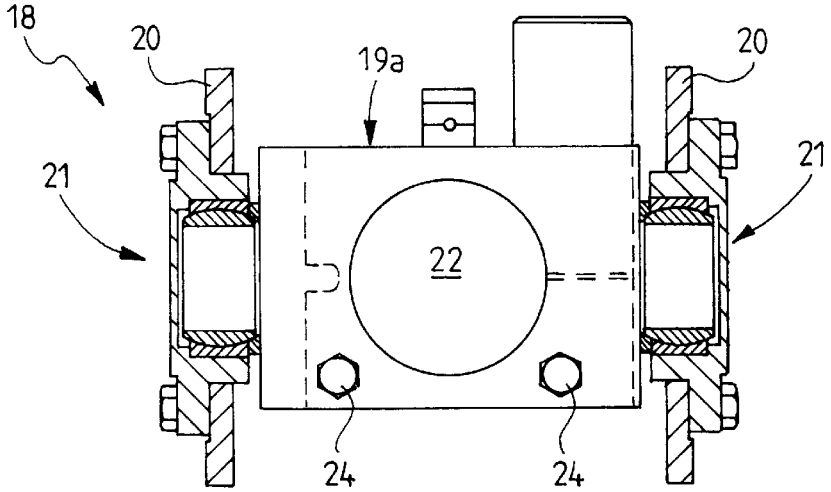
FIG. 4 is a sectional view from A to A of FIG. 3.
Figure 5:
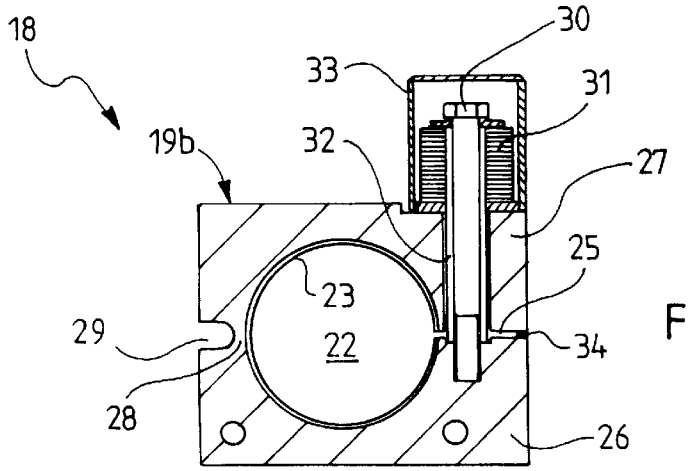
FIG. 5 is a sectional view from B to B of FIG. 3.

The friction device 18, which is shown in greater detail in FIGS. 3 to 5, has a body 19 that is arranged between flanges 20 mounted on the support platform 17 by means of pivot arrangements 21 which allow the friction device to turn about a horizontal axis of rotation that is parallel to the axis of rotation of the support beam 14. Inside the body 19 of the friction device 18 there is a channel 22 provided with a friction surface 23 glued thereto, through which channel the support bar passes. In this example, the body 18 comprises two parts 19*a* and 19*b* that are attached to each other with screws 24, and the pivot arrangements 21 are attached to the part 19*a*. On the other hand, means for generating and adjusting the friction force between the channel 22 and the support bar 16 are arranged in the part 19*b*. These means comprise a slit produced in the body part 19*b* on one side of the channel 22, the slit extending to the channel 22 and dividing the body part 19*b* on said side of the channel 22 into two parts, in other words, into an upper part and a lower part 26 and 27, and (the means further comprise) a link 28 formed on the other, opposite, side of the channel 22 in the body part 19*b*, and resilient tightening means 30, 31, which resiliently connect the body parts 26 and 27 on the opposite sides of the slit 25. The link 28 consists of a waisting which is produced in the body part 19*b* by means of a waisting groove 29 parallel to the channel 22 and which serves as an elastic link, in which tension generated by bending moment is weak in comparison with a state of tensile stress.

The tightening means comprise a plurality of screws 30 and spring means 31 mounted between the screw-heads and the body part 27 of the friction device, the spring means comprising a plurality of diaphragm springs in this example. When it is desired that the pre-tightening force of the tightening means is always adjusted to a given value, a bushing 32 can be placed between the screw-head 30 and the lower body part 26, whereby no torque spanner is needed for tightening the screw 30, since the torque becomes correct when the screw-head 30 comes into contact with the upper surface of the bushing 32. Since the tightening means 30, 31 are only in the body part 19*b*, in this example they have a substantial effect on the portion of the channel 22 of this body part only.

The diaphragm spring arrangements 31 are preferably protected with caps 33 and the slit 25 is protected with a seal 34. Correspondingly, the surface of the support bar 16 is protected with a boot seal 35 against outdoor air. Moreover, the friction surface 23 and the support bar 16 are selected to the effect that a prolonged state of mutual compression will not make them adhere to one another.

In order to stop the lifting mechanism immediately when the dampening apparatus 13 operates, a limit switch 36 is mounted in the body part 19*a* of the friction device, which limit switch stops the crane operation as soon as a coupling part 37, which is secured to the end of the support bar, is disconnected from the limit switch 36, when the support bar 16 starts moving.

The dampening apparatus simply operates in such a way that, when, in an overload situation, a load resting on the support bar 16, and the support beam 14 and sheaves 6 related thereto, exceeds the holding force of the friction device 18, the system consisting of the support bar 16, the support beam 14 and the sheaves 6 is allowed to release, whereby the system moves towards the friction device 18 for a predetermined stroke length, and slackens the lifting ropes and stops the crane's lifting mechanism by means of the above-mentioned limit switch 36. The safety factor of the release power is determined, for instance, to be in the range of 1.6 to 2.0 as compared with the normal load of the ropes. The stroke length of the dampening apparatus 13, i.e. the length of the support bar 16 movement is determined to suit for each particular application separately. In this solution, between the support beam 14 and the support platform 17, secured to said support platform, there is a shock reducer 38, against which the support beam 14 strikes in its extreme position, and which prevents the dampening apparatus 13 from being damaged. After the release, the apparatus is reset ready for operation by slackening the tightening means 30, 31 and by tightening them up again.

In the arrangement described in FIG. 1, the dampening apparatuses of the invention can also be placed in connection with devices 8 to 11 that prevent swaying and twisting, whereby in a dampening situation the movable means of the apparatus may move away from the friction device, i.e. in the opposite direction as compared with the above.

In the above, the invention is only described by means of one example. However, its details may vary within the scope of the appended claims, and it may have a plurality of other applications as stated earlier in the text.

What is claimed is:

1. An apparatus for reducing overload and dampening collision energy acting on lifting ropes of a crane, a support beam being provided for receiving a load from the lifting ropes, the apparatus comprising:

movable means for receiving a load from the support beam, the movable means including a support bar;

resistance means against which a predetermined resistance is applied for dampening movement of the support bar, the resistance means includes at least one friction device cooperable with the movable means, the resistance means being attached to the crane, the friction device comprising a body having a channel therein, the channel being provided with a friction surface, the support bar passing through the channel; and means for generating and adjusting friction force between the channel and the support bar.

2. The apparatus as claimed in claim 1, wherein the means for generating and adjusting friction force comprises;

a slit provided in the body on one side of the channel, the slit extending to the channel and dividing the body on one side of the channel;

a link formed on a side of the channel opposite to the slit; and resilient tightening means for connecting the body on both sides of the slit.

3. The apparatus as claimed in claim 1, wherein the link includes a waisting which is formed by a waisting groove which is generally parallel to the channel.

4. The apparatus as claimed in claim 1, wherein the resilient tightening means includes screws and springs means mounted between heads of the screws and the body of the friction device.

5. The apparatus as claimed in claim 4, wherein the spring means includes diaphragm springs.

6. The apparatus as claimed in claim 1, wherein the support bar is reciprocally held in the channel such that the support bar is movable in opposed directions in the channel.

7. The apparatus as claimed in claim 6, further comprising a limit switch provided between the friction device and the support bar, the limit switch being operable to stop operation of the crane when the support bar starts moving.

8. The apparatus as claimed in claim 1, further comprising a limit switch provided between the friction device and the support bar, the limit switch being operable to stop operation of the crane when the support bar starts moving.

9. The apparatus as claimed in claim 1, further comprising a limit switch provided between the friction device and the support bar, the limit switch being operable to stop operation of the crane when the support bar starts moving.

10. The apparatus as claimed in claim 1, further comprising a shock reducer for dampening collision energy.

11. The apparatus as claimed in claim 10, wherein the shock reducer dampens collision of a lifting element of the crane with a lifting carriage.

* * * * *